United States Patent [19]

Koboshi et al.

[11] Patent Number: 4,839,682

[45] Date of Patent: Jun. 13, 1989

[54] PROCESSING APPARATUS FOR DISC FILMS

[75] Inventors: Shigeharu Koboshi; Satoru Kuse; Masayuki Kurematsu; Nobutaka Goto, all of Hino, Japan

[73] Assignee: Konica Corporation, Tokyo, Japan

[21] Appl. No.: 165,582

[22] Filed: Mar. 8, 1988

[30] Foreign Application Priority Data

| | | | |
|---|---|---|---|
| Mar. 10, 1987 | [JP] | Japan | 62-35745 |
| May 14, 1987 | [JP] | Japan | 62-118669 |
| Sep. 8, 1987 | [JP] | Japan | 62-138088 |
| Sep. 16, 1987 | [JP] | Japan | 62-232927 |

[51] Int. Cl.[4] ..... G03D 3/02

[52] U.S. Cl. ..... 354/312; 354/322; 354/323; 354/330; 414/412

[58] Field of Search ..... 354/310, 311, 312, 313, 354/314, 315, 316, 319, 320, 321, 322, 329, 330, 323, ; 414/412; 29/426.4, 426.5

[56] References Cited

U.S. PATENT DOCUMENTS

| | | | |
|---|---|---|---|
| 4,076,135 | 2/1978 | Klose | 354/313 |
| 4,094,726 | 6/1978 | Hujer et al. | 354/313 |
| 4,208,116 | 6/1980 | Morse | 354/275 |
| 4,248,564 | 2/1981 | Gentile et al. | 414/412 |
| 4,497,559 | 2/1985 | Maris et al. | 354/330 |

*Primary Examiner*—A. A. Mathews

*Attorney, Agent, or Firm*—Jordan B. Bierman

[57] ABSTRACT

An object of the invention is to provide a processing apparatus for handling a disk film unit consisting of a disk-shaped photographic film and a cartridge having light shielding structure for storing the film, wherein, before loading the disk film unit onto the processing apparatus, it is not required to carry out any preparatory operation, such as an operation that the disk film is taken out of the cartridge by using a light-shielded cartridge opener provided separately from the processing apparatus or a cartridge opener in a dark room.

13 Claims, 8 Drawing Sheets

PROCESSING APPARATUS FOR DISC FILMS

BACKGROUND OF THE INVENTION

The present invention relates to a processing apparatus for processing at least a sheet of disc film (that is a photographic light-sensitive material in a disc form supported on a core and is incorporated into a light-shielded cartridge so as to constitute a film unit), especially to a processing apparatus capable of accomodating therein a cartridge storing an exposed disc film and processing the exposed disc film.

Generally, disc films on the market have so far been structured as shown in FIGS. 1 through 3. In the drawings, reference numeral 10 indicates a cartridge which integrates its exposure window side plate 11 and label side plate 12 into a light-shielding structure so as to prevent a disc film 20 from being hit by light. The exposure window side plate is provided with exposure window 13, central opening 14, window 15 for opening and closing a light-shielding plate, pin insertion hole 16 for opening and closing a light-shielding plate and opening 17 for breaking a cartridge, respectively.

Inside the exposure window, there is light-shielding plate 18 arranged concentrically with disc film 20. When inserting a pin into pin insertion hole 16 and rotating, with pressing, the protrusion of light-shielding plate 18 exposed to a portion of window 15 for opening and closing the light-shielding plate, disc film 20 will be exposed to a portion of exposure window 13.

To central opening 14, hub 21 of disc film 20 is exposed. To the rear side of label side plate 12, a member is exposed so as to press one frame portionof disc film 20 in the exposure position.

For the details of such disc films, there are the descriptions in, for example, U.S. Pat. No. 4,212,673 and Japanese Patent Publication Open to Public Inspection Nos. 113525-1978, 101940-1980 and 101942-1980; for the details of such cartridge openers, in U.S. Pat. Nos. 4,208,116 and 4,248,564; and for the general details, in 'The Whole Story of Kodak Disc Film System', Photographic Industries, April, 1982, pp. 26–41; respectively.

It has heretofore been usual that exposed disc films have been collected to the so-called 'labs', i.e., centralized film processing facilities so as to process them with large-sized automatic processors, and that dental X-ray films have been processed by hand.

In the case of processing disc films with an automatic processor, e.g., in the case of the Kodak system, with either a manually operated Disc-Opener Model H or an automatically operated Disc-Opener Work-Center, a push-pin is inseted through opening 17 for breaking a cartridge provided to exposure window side plate 11 so as to press label side plate 12 and, at the same time, to push out the bottom center portion 19 of exposure window side plate 11 to the reverse direction to that of the push-pin or to bring the bottom center portion 19 to a standstill. First, each cartridge is broken and the disc films are taken out to the outside. Second, a batch of the films is repacked in a light-shielded magazine and the batch of films and the magazine in all are loaded in an automatic processor, so that they may be processed.

For photofinishing roll films, speedy processing services such as a one-hour service have been routine with the spread of the so-called mini-labs. As compared to the above, the photofinishg facilities in Japan capable of DPE servicing disc films are still unevenly located. It is, therefore, hard to deny customers' impressions that the disc film photofinishers cause a serious delay in servicing. It is the present status in Japan that disc films have not been popularized yet, despite disc films have various advantages as photographic system.

Taking the above-mentioned present status in Japan into consideration, the inventors have proposed a compact-sized system in which a super-miniature type automatic processor capable of processing one to several pieces of disc films is installed at a substantially small shop space of DPE shops or the like so as to give speedy photofinishing services, and also proposed various improvements in photographic processing methods or the intruments thereof. The invention corresponds to a series of the proposals.

It is a principal object of the invention to provide an automatic processor which is particularly suitable to be used in a subminiature photographic processing system in which disc film processing services may instantly be rendered even at substantially small shops such as camera shops, and may safely and readily be operated by any unskilled operators.

As one of the solutions for aforesaid difficulties, it has been suggested to process the disc film without taking it out of a cartridge. However, there are many points to be solved before putting it to practical use, such as how to supply processing solutions into the cartridge and drain them from it, how to take the disc film out of the cartridge and how to find out the best structure for miniaturizing the apparatuses.

SUMMARY OF THE INVENTION

Taking the above-mentioned background into consideration, it is the primary object of the invention to provide a processing apparatus without requiring any preparatory procedure before putting a disc film-loaded cartridge in the processing apparatus, such as a procedure that a disc film is taken out of a cartridge by a light-shielded cartridge opener provided separately or by a cartridge opener used in a dark room.

The above-mentioned object of the invention can be attained with a processing apparatus for disc film comprising a processing chamber where a film unit to be processed is set, a cover means that keeps the processing chamber in the watertight and light-shielded state, a cartridge opener which breaks the whole or a part of a film cartridge in the film unit, a means for supplying processing solutions to the processing chamber, and a means for rotating a disc film.

One of the preferable embodiments of the invention is to comprise a means for vibrating a disc film and/or processing solutions, in place of or in addition to a means for rotating a disc film.

Another object of the invention is to provide a processing appratus for processing disc films in which a film unit stored in a cartridge is set therein and a disc film is then taken out of the cartridge by a built-in cartridge opener so as to be processed and, more particularly, to provide an automatic disc film processor having a safety device for preventing every disc film surface from being erroneously exposed to light or from being scratched or otherwise damaged by the broken pieces of the cartridge which are produced when the cartridge is broken.

The above-mentioned objects of the invention can be achieved with an automatic processor having a system that a cartridge opener is incorporated thereinto and a sheet-form photographic light-sensitive material having been taken out of a cartridge by said cartridge opener is dropped downward and is then guided into a processing section so as to be processed for development and so forth; wherein, a lightshielding member is provided to the underneath of the cartridge opener so as to keep both of the upper mechanism including said cartridge opener and the lower processing section in the light-shielded state and a stopper is so provided as to prevent both of a disc film and the broken pieces of the cartridge from dropping directly into a processing tank when the disc film is taken out of the cartridge and when the cartridge is broken, respectively.

This invention relates to a means for shielding the inlet of a film unit.

One of the objects of the invention it to provide a light-shielding means of the film unit inlet in an automatic processor of such a type that a film unit is loaded in the automatic processor as it is without taking an exposed disc film out of a cartridge and the disc film is taken out of the loaded film unit automatically and is then guided to a processing section so as to be processed.

The above-mentioned objects of the invention can be achieved with an automatic processor comprising a film unit inlet provided with a light-shielding means capable of opening and closing the inlet automatically.

Another object of the invention is to provide an automatic processor of such a type that a film unit is loaded as it is in the processor and, the disc film is taken out of the loaded film unit automatically and is then guided to a processing section, so as to be processed.

The above-mentioned object of the invention can be achieved with an automatic processor for processing disc films, which is capable of taking out and processing a disc film after a film unit subject to a processing is merely putting as it is into the processor; the processor comprising a means capable of separately delivering an empty cartridge from which the disc film was taken out and the disc film already processed from separate outlets, respectively.

BRIEF DESCRIPTION OF THE DRAWINGS

FIG. 11 is a perspective view illustrating an example of the light-shielding means of the invention.

DETAILED DESCRIPTION OF THE INVENTION

Figure 1:
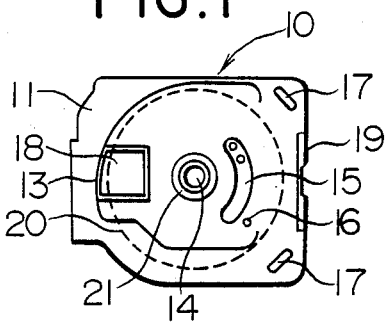
FIG. 1 is a plan view of a cartridge used in a disc film unit placed on the market.
Figure 2:
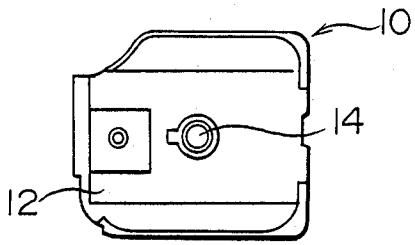
FIG. 2 is a bottom plan view of the same as in FIG. 1.
Figure 3:
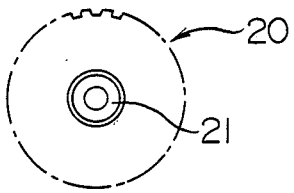
FIG. 3 is a plan view of a disc film.

The invention will be explained in detail as follows, referring to the drawings attached.

Figure 4:
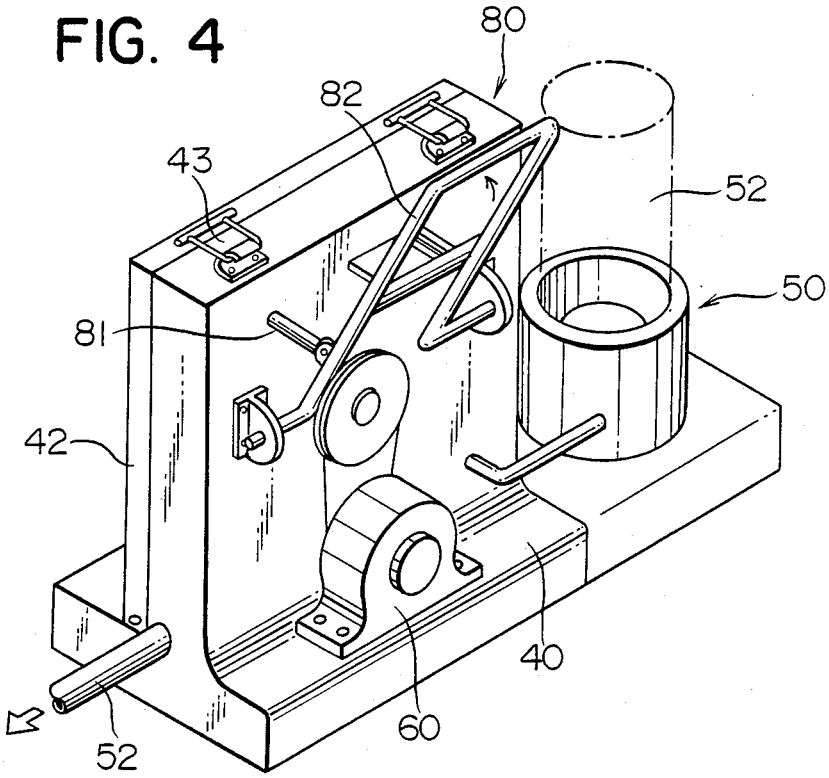
FIGS. 4 and 5 represent perspective views showing an example of the invention.
Figure 5:
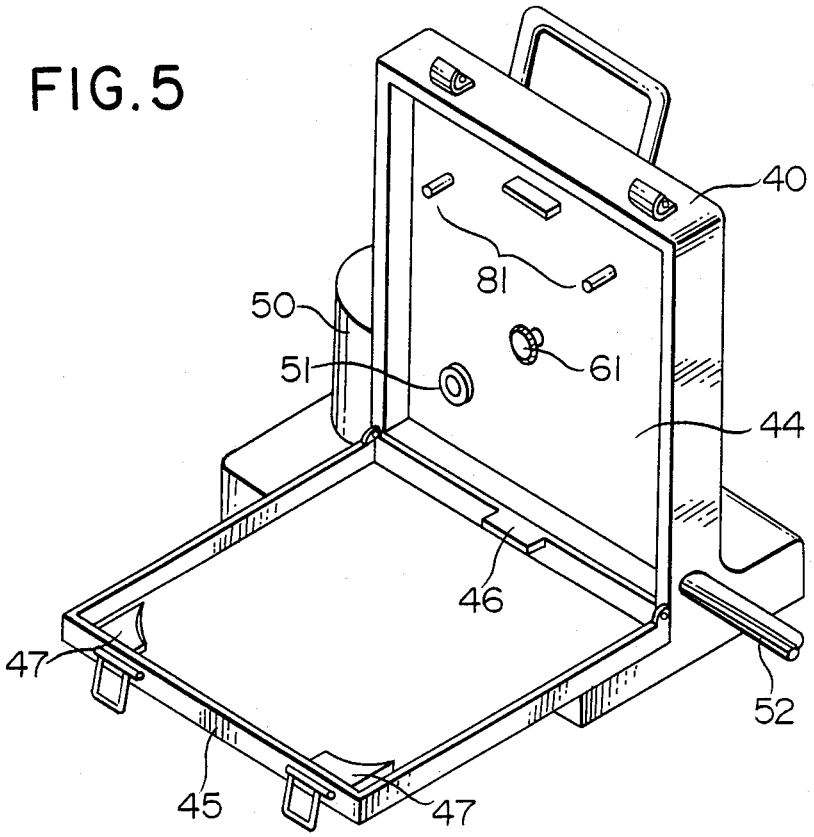
Figure 6:
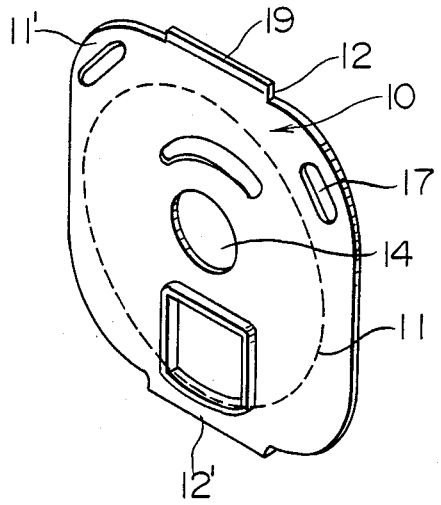
FIG. 6 is a perspective view of a film unit.

In FIGS. 4 and 5, the numeral 40 is a frame and processing chamber 44 that is of a watertight and light-shielded structure type is formed when cover means 42 is closed on the frame 40 by means of buckle 43. Processing solutions are supplied to processing chamber 44 through guide opening 51 by means of processing solution supply means 50, and after processing for a certain period of time, waste solutions are drained outside through drain pipe 52 that is led from processing chamber 44. The numeral 60 is a motor and when engaging end 61 protruding in processing chamber 44 engages with center core 21 of disc film 20 in film unit 10 shown in FIG. 6, the operation for rotating disc film 20 is made during the processing period. The disc film may also be rotated manually, instead of being rotated by motor 60. Further, it is preferable that a disc film and/or processing solutions are vibrated, in place of or concurrently with the rotation of disc film. The vibration may be given directly to the disc film from the vibrator arranged in the processing chamber 44, or given to processing solutions or may be given by placing the whole developing appartus shown in the drawing on the vibration stand, and the vibration frequencies in the low frequency zone as well as those in the ultrasonic wave zone may be used preferably.

Base edge 12' of label side plate 12 of the cartridge loaded and both edge portions 11' and 11' of exposure window side plate 11 of the cartridge are fixed respectively by stoppers 46 and 47 provided on the cover means 42.

The numeral 80 is an opener which is composed of pressing member 81 that protrudes into processing chamber 44 and presses both edge portions of label side plate 12 through openings 17 and 17 provided on exposure window side plate 11 as well as of operating member 82 that operates the pressing member 81. The base portions of operating member 82 are supported by the bearing portions fixed on the frame 40 as shown in the figure, and when it is rotated in the direction marked with an arrow, pressing members 81 are protruded on the theory of a lever. In this case, when the cartridge is set at the prescribed position, the movement of exposure window side plate 11 is checked by stopopers 47 and 47, and thus, an edge portion only of label side plate 12 is pressed by the pressing member 81, which causes the portion where both boards are jointed to be broken and thereby causes the cartridge to be opened to a V-shaped posture. When a locking means that is not shown in the figure is provided for locking the operating member 82, the cartridge may be kept in the state of being openend to a V-shaped posture.

Figure 7:
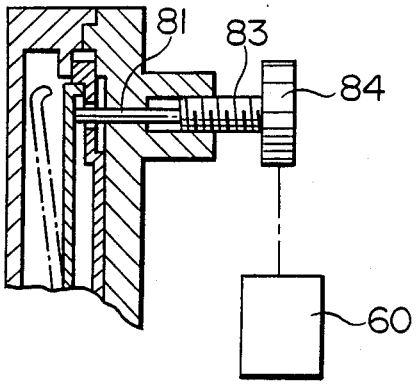
FIGS. 7 and 8 are cross-sectional views showing other examples of a cartridge opener.
Figure 8:
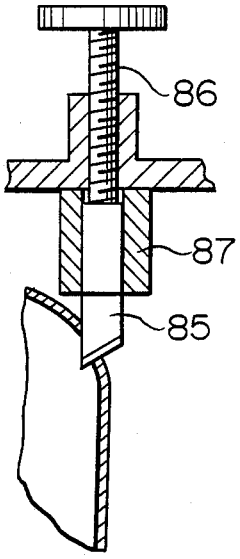

FIG. 7 represents an example wherein operating member 81 is operated by motor 60. Namely, screw 83 is so arranged as to be concentric to the pressing member 81 and gear 84 fixed on the screw 83 is rotated by the motor 60, which enables the motor with a small torque to break the cartridge with a big force.

Inicidentally, some disc films availabe on the market have different methods of jointing two cartridge-forming boards which make it impossibe for only the cartridge opener of a cartridge-breaking type shown in FIG. 4 to break and separate cartridge boards. For the cartridge of this type, it is preferable, as shown in FIG.

8, to use blade 85 that advances linearly along the line where two cartridge-forming boards are jointed, in addition to or in place of the cartridge opener of aforesaid breaking and separating type.

As a method for advancing the blade 85, it is preferable to employ the method wherein screw 86 is rotated and thereby the blade 85 is pushed forward lineary through the guide 87 without being rotated, though the method which simply pushes the blade 85 forward is acceptable.

As for the supply of processing solutions in the arrangement shown in the figure, it is preferable to supply, by pressing the piston manually, the solutions contained in the injector-shaped container 52 prepared for each processing solution to the processing chamber 44 through guide inlet 51. The amount of processing solutions supplied that causes the exposure window on the cartridge loaded in the position shown in FIG. 6 to be soaked in the solution is acceptable.

Since the cartridge is opened and kept to be in a V-shaped posture when solutions are supplied to processing chamber 44, solutions more in quantity than those for cartridge not opened may arrive at the image portion on a disc film and the disc film is further turned, which improves the processing efficiency.

Waste processing solutions are drained outside through drain pipe 52 and it is preferable, in this case, that a valve is provided on the drain pipe 52 or the suction pump is used for the forced drainage.

For processing solution supply means 50, various kinds of embodiments are acceptable in addition to that shown in the figure.

In the processing apparatus according to the invention, it is possible to conduct processing easily only by setting the cartridge containing therein the exposed disc film, and it is also possible to take the processed film out of the cartridge manually without difficulty, which enables the object of the invention described at the beginning to be attained.

With respect to a processing apparatus in which a film unit is set in and is then taken out by a built-in cartridge opener so as to process a disc film, a description will now be made about an example of an automatic disc film processor having a safety device for preventing every disc film surface from being scratched or otherwise by the broken pieces of the cartridge which may be produced when the cartridge is broken.

A. Cartridge loading

Different from the conventional cases where disc film 20 having been taken out of cartridge 10 in advance by cartridge opener is loaded in an automatic processor, in the automatic processor of the invention, disc film 20 is loaded as it is stored in cartridge 10.

There are two embodiments of loading cartridge 10 in the automatic processor of the invention. Namely, in one embodiment, cartridge 10 is loaded by making use of an applicator and, in the other embodiment, cartridge 10 is loaded directly in the processor.

The edge portion on the exposure window side of cartridge 10 is fixed by a fixing means to keep cartridge 10 hung, and an applicator 100 shown in the drawing is then fitted into cartridge insertion opening 111 of processor frame 110. In this instance, cartridge insertion opening 111 is shielded against light with applicator 100. For more safety sake, it is preferred to shield the surroundings of applicator 100 against light.

In the embodiment not using any applicator 100, cartridge 10 is inserted, in the posture shown in the drawing, into cartridge insertion opening 111. The bottom end of cartridge 10 is supported by a stopper (not shown) and the exposure window side end of cartridge 10 is fixed by a simple vise or the like. When it is fixed and the upper portion of cartridge 10 is shielded from light, all is set to operate and, at the same time when a cartridge opener starts to operate, the stopper having supported cartridge 10 escapes to make the lower space of cartridge 10 open.

B. Cartridge opener

When cartridge 10 is completely loaded as mentioned above, disc film 20 is to be taken out of cartridge 10 by the cartridge opener.

Figure 9:
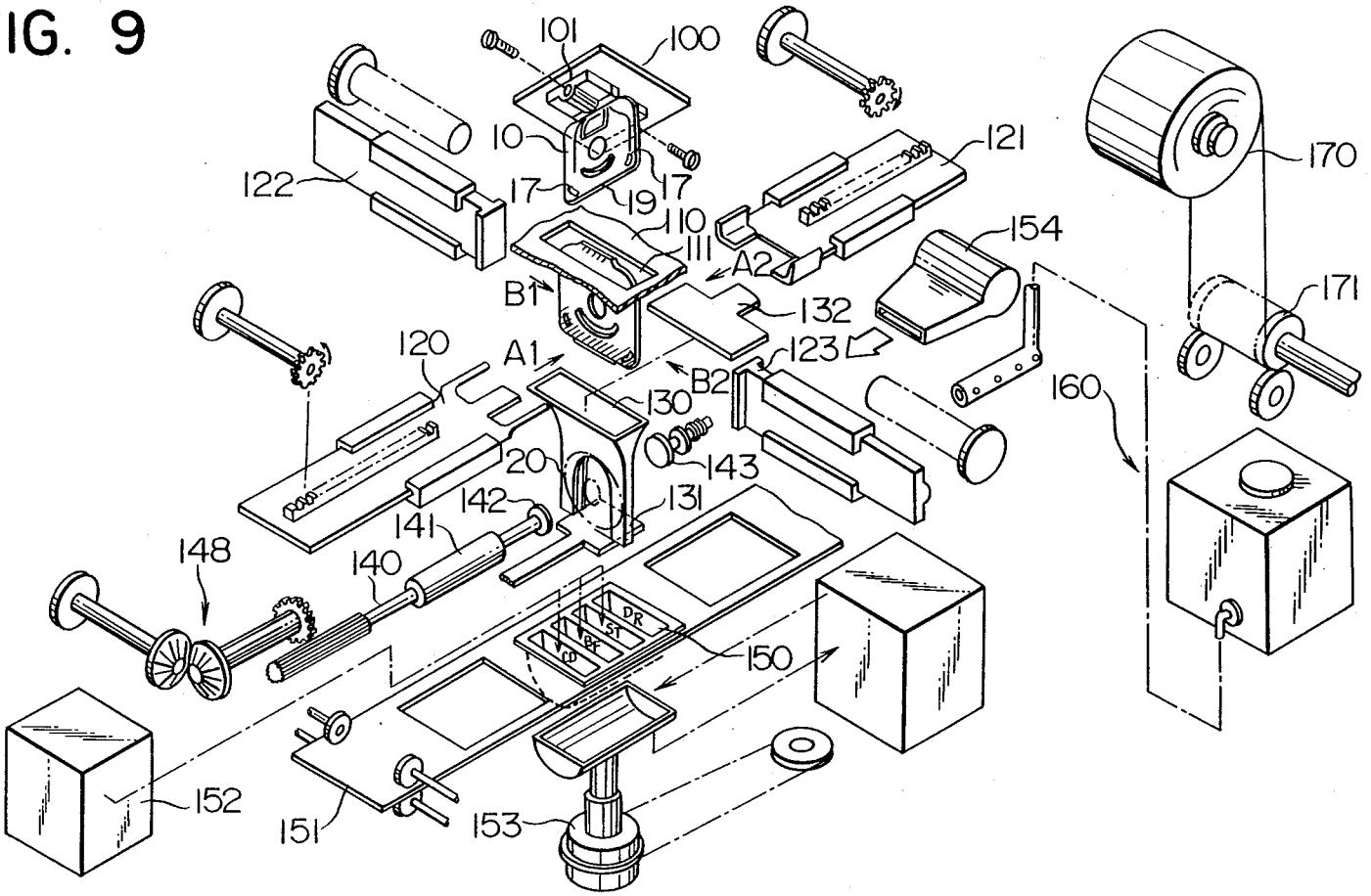
FIGS. 9 and 11 are schematically exploded perspective illustrations of an automatic processor of the invention.

FIG. 9 illustrates an example of the cartridge opener applicable to the automatic processors of the invention. In this type cartridge opener, the portion indicated by slant lines on the side opposite to exposure window 13 is broken in the first step. When this portion is broken, pressures are applied from the directions indicated by arrow marks A1 and A2, respectively, similar to the case of using the conventional cartridge openers. Namely, the surroundings of the rear side of openings 17, 17 are pressed with a pressure applied from the direction of A2 (including a stationary state made by the stopper) and, at the same time, the lower end of label side plate 12 is pressed with a pressure from the direction of A1, through openings 17, 17 of exposure window side plate 11. In this case, the points of action of cartridge end breaking member 120 to label side plate 12 are preferably in the positions of the inside of openings 17, 17 and lower center portion 19 each of exposure window side plate 11 and, the pressures applied to the direction of A1 and A2 are equivalent to the tensile strength to the reverse direction. Therefore, in the practical processors, there may be a case that a push-rod, a pin or the like is linearly moved; another case that a member having a hook is linearly moved, i.e., tensionally moved, in the reverse directions to those of A1 and A2, respectively; and a further case that the above-mentioned cases are combined together to operate.

The pressure from the direction of A2 may be a simple static pressure. In order to break cartridge 10 efficiently, cartridge end breaking member 121 may be used.

The cartridge openers utilizing a tensional operation include, for example, that described in Japanese Patent Application No. 70083-1986 applied by the present patent applicants. These openers may be utilized as a part of the cartridge openers of the invention.

The pressure force applied to the directions of A1 and A2 may be obtained by various means including, for example, a means of converting the rotatory power of a motor into a linearly receiprocating movement by making use of a rack-and-pinion gear or the like; another power-doubling means utilizing a screw or a worm gear; a further means utilizing a solenoid action; a still further manually operating means utilizing the principles of a lever; and so forth. They are selectively applied so as to meet the requirements for miniaturizing automatic processors.

After the lower end of cartridge 10 is broken, the sides of cartridge 10 are pressed by pressing members 122, 123 in the directions of B1 and B2, respectively, so that the two plates which form cartridge 10 may be bent.

It may also be embodied that one of pressing members 122, 123 may be served as a stopper in a stationary state.

Also for preventing one of the two plates forming cartridge 10 from bending or cracking apart, it is preferred to devise the two plates to be bent evenly by making the front end of each pressing members 122, 123 into the form of concavity, ship's bottom or the like.

The momenta of pressing members 122, 123 in the directions of B1 and B2 are so regulated as not to affect disc film 20. Namely, if the momenta thereof are too large, there may cause not only damage on the welded portions of cartridge 10 but also a fear that the emulsion surface of disc film 20 may be damaged, because the plates themselved are cracked apart. It is therefore preferable to bend the plates to such an extent that a stored disc film 20 may be made so free as to drop down without giving any damage to the welded portions on the sides of cartridge 10.

From the viewpoint of preventing the emulsion surface of a rotatively operated disc film 20 from being damaged by dropping the broken pieces of a cartridge into a processing tank, or from the viewpoint of trying the reuse of cartridge 10, it is advantageous that the welded portions of the sides of cartridge 10 is not damaged. Also from the viewpoint of providing an automatic processor with a means for automatically taking cartridge 10 out and delivering it to the outside of the processor, it is also advantageous that cartridge 10 retains its original shape even after disc film 20 is taken out of the cartridge 10.

Besides, from the viewpoints of preventing cartridge 10 from being damaged, fragments from occurring, disc film 20 from being scratched and so forth, it is preferable to carry out the pressing operation of pressing members 122, 123 not drastically but gradually. It is also allowed to press cartridge 10 not only by pressing it in a one-way direction but also by the repetitions of pressing and restoring operations. When cartridge 10 is pressed to a maximum momentum and thereafter, it is particularly preferable to carry out a restoring operation gradually and to repeat pressing and restoring operations. It is also allowed to vibrate or swing pressing members 122, 123, instead of the restoring operation. By the above-mentioned repetitions of pressing and restoring operations or by the vibrating or swinging operation, a stored disc film 20 is freely dropped from the bottom end of cartridge 10 of which welded portions were broken.

As for the cartridge openers applicable to the automatic processors of the invention, it is preferable to use those of such a system that cartridge 10 is broken and disc film 20 inside is dropped downward. The cartridge openers relating to the invention shall not be limited thereto, but those described in, for example, in Japanese Patent Application Nos. 21859-1986, 21860-1986, 29130-1986 and so forth each having been applied by the present patent applicant may also be applied. These cartridge openers include those of such an embodiments that the side welded portions of a cartridge is cut away by a cutter mans.

After disc film 20 is taken out, cartridge 10 is delivered out of a processor. For the cartridge deliveries, there have been various means adoptable. They include, for example, a means in which cartridge 10 is retained in the original position where the cartrige was broken and is then delivered out of a processor manually; another means in which, while a cartridge is being held by pressing members 122, 123, it is delivered out a processor by the upward or horizontal motion of the pressing members 122, 123; a further means in which cartridge 10 is delivered out of a processor in the same motion of a cartridge delivering member as that of pressing members 122, 123; a still further means in which an applicator is provided thereto and the upper end of cartridge 10, for example, is held with a chuck in advance, and disc film 20 is then taken out of the chucked cartridge 10 to the outside of a processor by making use of the applicator.

C. Retention and rotation of disc film

A disc film 20 already freed from cartridge 10 is freely dropped down so as to be quided to guide member 130 and is then stopped in the position of stopper 131 provided to the lower part of guide member 130.

If reciprocating light-shielding plate 132 is provided to the upper side of guide member 130 so as to shield the upper portion of guide member 130 after disc film 20 is dropped down, it is possible to take out applicator 100 so as to detach empty cartridge 10 and then to load the next cartridge 10. In such an embodiment as described above, it is preferable to regulate the operations of applicator 100 or other means and the light-shielding means so as to be interlocked together. For example, when light-shielding member 132 is not positioned on the upper side of guide member 130, it is preferable to lock up light-shielding member 132 so that applicator 100 or the light-shielding cover provided to the surroundings of cartridge insertion opening 111 may not be detached. The state of light-shielding member 132 may be detected with, for example, an electric switch which is switched ON and OFF according to the movements of shielding member 132, a member which is movable according to the movements of light-shielding member 132, or the like. In the case that light-shielding member 132 is opened, applicator 100 or the like is so regulated as to be locked up.

Light-shielding members 132 shall not be limited to plate-shaped ones, but it is allowed to adopt those having any structures such as those of the curtain-shaped and those constructed with two plates to be opened and closed like a French doors.

During a cartridge opener is being operated, light-shielding member 132 is in the opened state. When a sensor detects that disc film 20 was dropped down, the upper side of guide member 130 is shielded against light by light-shielding member 132. The dropping of disc film 20 may be detected by the sensor through a shock or change of weight caused by dropping disc film 20 onto stopper 131, for example. The weight of disc film 20 is about two grams. When dropping it from a height of about 5 cm, a shock of about 6 grams or more may be given. For this purpose, therefore, electric switches or other various weight sensors may be utilized.

The above-mentioned structures are particularly advantageous to design the automatic processor shown in the drawings so as to have such a specification that two or more disc films may be processed at a time.

In the meantime, disc film 20 which has been stopped by stopper 131 is then egaged round with spindle shaft 140. In the processor shown in the drawings, spindle shaft 140 is held by bearing 141 fixed to the base plate of the processor and is moved in the direction of the arrow automatically or by a handle, so that the tip of the spindle shaft 140 may hold disc film 20.

As for the means for holding disc film 20 to the tip of spindle shaft 140, there are an embodiment that spindle shaft 140 is made hollow and a rod is so arranged to the inside of the shaft as to be able to put in and out and a chuck privided to the tip of spindle shaft 140 is operated thereby, so that the hub of disc film 20 may be coupled to the shaft 140. Besides the above, there is another embodiment that the neighborhood of the hub of disc film 20 is engaged sandwich-like with a pair of clutch discs 142, 143, as shown in the drawing. In these embodiments, it is also allowed to fit one of clutch discs 143 to the tip of the shaft moving toward the direction of the arrow so as to make the clutch disc 143 freely rotatable but not to drive the shaft 140.

Figure 10:
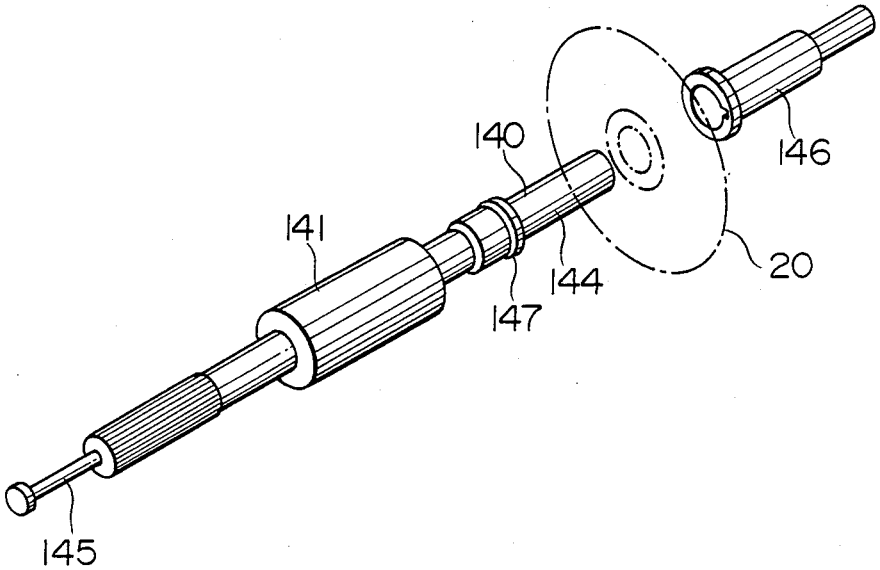
FIG. 10 is a perspective view of another embodiment of spindle shafts.

Though such a disc film holding means with clutch discs 142, 143 as mentioned above may still be able to hold not much exceeding 4 or 5 disc films at a time, if disc films more than the above, e.g., 10 films or less, are to be held, they may be held by such a system as shown in FIG. 10. Namely, a slit is formed to extend over several centimeters from the tip of spindle shaft 140 held by bearing member 141, (the tip of spindle shaft 140 should preferably be tapered so as to readily be coupled to the hub of disc film 20 or should preferably be formed into a female-shape so as to readily be coupled to pushing-in member 146. Coupler piece 144 is then exposed to the slit so as to be put in and out by rod 145. Namely, coupler piece 144 is pulled in by drawing rod 145 and the hub of disc film 20 shown by imaginary lines is pushed into the position of stopper 147 by moving pushing-in member 146 in the direction of the arrow and, then, coupler piece 144 is protruded from the slit by pushing rod 145 in, so that disc film 20 is fixed. Disc film 20 may be taken out of spindle shaft 140 in such a manner that coupler piece 144 is pulled in by pulling rod 145 in and stopper 147 is then moved in the direction of the arrow.

It is also allowed to engage disc film 20 with spindle shaft 140 without providing pushing-in member 146 but in such a manner that disc film 20 is hindered from moving to the right in the drawing by the skirt portion of guide member 130 shown in FIG. 9, and spindle shaft 140 is moved far over to the right, so that disc film 20 may be engaged with spindle shaft 140.

When disc film 20 is coupled to spindle shaft 140, stopper 131 is moved to escape from the lower part of guide member 130 so that the space below disc film 20 may be freed. At this moment, broken pieces or the like, which might have been produced when cartridge 10 is broken by a cartridge opener, may be dropped onto the upper side of stopper 131 and may then be discharged to a waste discharge path (not shown) while stopper 131 is being moved to escape, so that the accidental disfigurements of the rotating disc film 20 may be prevented from occurring by dropping the broken pieces into a processing tank.

Spindle shaft 140 is rotated by driving system 148 which is operated by hand or a motor.

In the case of an embodiment in which a processing tank is not made up and down, a means for making spindle shaft 140 up and down is to be privided instead, though the means relates to the undermentioned up-and-down operation of a processing tank.

Spindle shaft 140 togehter with disc film 20 may be made up and down in such a manner that a shaft (not shown) capable of being made up and down vertically is fitted to bearing member 141 and is then made up and down by hand or automatically.

Instead of the above-mentioned structures, it is also applicable with various structures such as a structure that bearing member 141 is fitted to the tip of an arm member rotatable by operating a handle or automatically and another structure that a rotary movement is converted into a vertical reciprocating movement by a linkage means or a motor instead of a simple arm member. In a simple arm structure, disc film 20 does not move up and down vertically but it moves with a slight circular movements. On the other hand, the linkage structure has such an advantage that disc film 20 may be moved up and down vertically.

D. Processing solution supply and the temperature control thereof

Numeral 150 is a vessel for containing a photographic processing solution. Namely, this is used as a processing solution supply vessel in a supply system, a processing tank in a photographic processing system and a waste solution vessel in a waste disposal system, respectively.

The photographic processing solution is supplied in the same form as in the first-mentioned embodiment in which supply vessel 150 contains a processing solution already adjusted to be in a liquid state which is not needed for any pre-treatment except at least a temperature control, or in the same form as in the second embodiment in which supply vessel 150 contains a processing material in the form of a concentrated solution or in the powder or jelly form.

In the first embodiment, vessel 150 is guided to the processing section of a photographic processing system by a vessel transport means operated by hand, an applicator, a belt, a rollaway bed or the like and this vessel 150 is immediately utilized as a processing tank for dipping disc film 20 to be processed therein.

In the second embodiment, after vessel 150 is guided to an appropriate position, the photographic proccessing solution contained therein is diluted or dissolved with such an diluting or dissolving solution as warm water preheated to a temperature of the order of 60° C. and stored in a small-sized tank, by making use of dissolving solution supply means 152. Both temperature and concentration of the diluted or dissolved processing solution are then suitably adjusted to be applied to a photographic processing, so that it may be utilized for the photographic processing.

When the processing solution is used in a total amount not much exceeding 10 ml, it is allowed to jointly use such a heating means that the whole body of the processing tank is dipped into such a beat medium as circulating hot water or the like; that processing tank 150 is so dual-structured as to ciculate such a heat medium as hot water inside; that hot air is applied to the bottom of processing tank 150; that the processing tank 150 is heated by a heater; or the like heating means.

When hot water is added as a dissolving or diluting liquid into processing tank 150 and if the temperature thereofof is relatively low, the temperature adjustment of the processing solution is carried out in the above-mentioned heating methods in most cases.

With the automatic processors of the invention, it is preferred to process disc film 20 with rotating it. Any size of the processing tank will be good enough to use, provided, for example, only a crescent-shapped part of disc film 20, may be dipped in, but the whole body of disc film 20 is not needed to be dipped in.

Accordingly, any depth and width of each of the processing tanks, CD, BF, ST, DR, may be good enough to use, if each disc film 20 may be dipped vertically down to at least the hub portion of the film 20 and each processing solution may be stored in an amount necessary to process the disc film 20 in each tank. The thickness of each tank relates to the number of disc films 20 to be processed.

Inside the processing tanks, there are a color developer (a CD solution), a bleach-fixer (a BF solution) and a washless stabilizer ( a ST solution) each of which was already prepared, or those adjusted by dissolvening solution supply means 152 such as an addition of hot water so as to be a temperature and a concentration suitable for processing, respectively. Disc film 20 having been held is dipped into one of the processing solutions by descending spindle shaft 140 or by ascending the processing tank by making use of a lift 153 and is then processed while it is rotated. For example, when a color developement is completed, disc film 20 is pulled up from a color developer by ascending spindle shaft 140 or by descending the processing tank by making use or lift 153 and, preferably, after rotating the disc film 20 so as to spill the color developer adhered to the film, spindle shaft 140 is moved horizontally or the processing tank is moved by transport means 151. Next, disc film 20 is so descended again as to be dipped into bleach-fixer tank BF, so that a processing may be carried on. The next and subsequent processing steps may also be carried out in the same manner.

In addition to the above embodiments, the invention includes another embodiment that no drying chamber DR is provided to vessel 150.

The invention also includes a further embodiment that spindle shaft 140 does not select one of the processing tanks by its lateral movements, but holds disc film 20 so as only to make it up and down. In this embodiment, each of tanks CD, BF, ST, DR of vessel 150 is moved one after another to the processing position where disc film 20 is made up and down by making use of transport means 151 comprising conveyor belt, rollers or the like and disc film 20 is the processed. As shown in the drawing, where there is provided with a means capable of moving vessel 150 not only horizontally but also longitudinally with lift 153, spindle shaft 140 will be good enough to have only a mechanism simply for holding and rotating disc film 20 in a stationary position.

In vessel 150, the processing solution content of each processing tank depends on how many disc films 20 are to be processed at a time. If a single disc film 20 is processed, for example, 10 ml of CD solution, 10 ml of BF solution and 10 ml of ST solution are required to use, provided that it is preferred that an ST processing should be separated into two and 10 ml each should be required to use. It is also preferred that each solution used should be in an amount not overflowing the upper edge of processing tank 11.

In the above described embodiments, vessel 150 is segmented into a plurality of processing tanks. It is also allowed to embody vessel 150 to make every processing tank, i.e., every processing solution, independent from each other, but not to aggregate processing tanks CD, BF, ST, DR and, more preferably, to unite the processing tanks into one aggregation when using.

When a washing step is completed, water drops adhereto to disc film 20 are spilled away by a centrifugal force of the rotation of disc film 20 and, at the same time, the disc film 20 is dried up with the hot air blown from a hot air drying mean 154.

It is preferred to cover the upper part of disc film 20 so as to prevent ST solution from scattering about when rotating the disc film 20 to spill water drops away in a drying step. There are covering structures such as one that a cap-shaped member is pushed on top of disc film 20 and pulled out therefrom, or another one that both of the aforementioned guide member 130 and the light-shielding member thereof are utilized as a top cover in a drying step. In the latter structure, it is preferable that hot air may be blown against the inside of the light-shielding and guide members, becausr these members themselves may also be dried up at the same time.

Disc film 20 thus dried up is taken out automatically from spindle shaft 140 and is then delivered out of a processor through a guide path. It is the matter of course that the invention shall not exclude an embodiment that disc film 20 is taken out of spindle shaft 140 by hand.

E. Disposal of photographic processing wastes

When the necessary processings are completed in a photographicc processing system, vessel 150 serving as the processing tanks is taken out of the processing section by hand and is then transferred to a waste solution disposal system by a transport means 151 which moves a conveyor belt, rollers or the like linearly or by another transport means such as a turn-table or the like which turns round.

In the waste solution disposal system, for example, a photographic waste solution is solidified when it remains in vessel 150 which served at this time as a waste solution vessel, which had served as a processing solution supply vessel and a processing tank formely, and the vessel is then sealed.

The position of the waste solution disposal system may be the same as that of the photographic processing system. In an embodiment that vessel 150 is supplied as new processing tanks so as to process the next and subsequent disc films 20, the preceding vessel 150 storing a waste solution already worn out in the previous processings is rapidly displaced from the processing section of the photographic processing system.

Such a waste solution may be solidified by making use of, for example, solidifying agent adding means 160. As for the solidifying agents, various ones may be utilized. They include, for example, the water-soluble polymers described in Japanese Patent Application No. 293799-1985 and the solidifying and drying agents described in Japanese Patent Appliction No. 259003-1986. Among them, vegetable or animal solidifying agents capable of solidfying waste solutions into the agar or jelly form and, more preferably, highly liquid-absorbing resins in the form of grain or powder and the like may be used. It is also allowed to add fiber-like substances together with the above-mentioned solidifying agents, at the same time.

The mechanisms for adding powder solidifying agents which may be adopted to the invention include, for example, those in which, as shown in FIG. 1, one of a double pipe having respective outlets is rotated to make two outlets coincide together so that powder solidifying agent may be spilled out.

The purpose of adding such a solidifying agent is to prevent a waste solution from scattering when an operator handles it or the waste solution is transported. Taking the reclamation of waste solutions into consideration, it is not preferable to use a solidifying agent disadvantageous to the reclamation.

It is also allowed to add such a solidifying agents in such a manner that, for example, a sharp nozzle or the like is used to pierce a seal so as to add or inject a solidifying agent, after a vessel was tightlyt sealed.

Vessel 150 is tightly sealed in such an embodiment as mentioned below.

(1) An embodiment in which a waste solution vessel is sealed with the sealing member which has sealed processing solution vessel 150 of a processing solution supply system. In this embodiment, a processor used is to be equipped with a mechanism of pealing the sealing member off from supply vessel 150 and repasting it again over a waste solution vessel. In this embodiment, the sealing members include not only a thin sheet-form plastic film, synthetic paper or the like, but also a so-called cover made of a hard material.

(2) Another embodiment in which, as shown in the drawing, the upper side of a vessel is sealed with a roller-like or leaf-like sealing member 170 which has been provided in advance, by making use of such a sealing means 171 as a roller-heated.

The embodiments for pasting a sealing member also include, besides the above-mentioned embodiment using the heat, those using an adhesive or glue, and those using a self-adhesive film.

(3) A further embodiment in which the surface of a waste solution is sealed, as the temperature of the waste solution is lowered, by adding thereon such a liquid-form sealing member as a wax or the like which is solified at an ordinary temperature. In this instance, it is preferred that the waste solutions should be solidified in the agar or jelly-form by adding the above-mentioned solidifying agent before the sealing member is added thereon. However, it is also allowed to apply such an embodiment that a sealing member may be added directly to the waste solution surface without carrying out the above-mentioned solidifying procedure.

In the latter embodiment, a sealing member is to be liquidified by heat in advance or to be liquidified or fused by the heat of the waste solution. It is preferred to use a sealing member having a specific gravity lighter than that of the waste solution. In this instance, when the sealing member is added as it remains in the liquid form into the waste solution, the sealing member comes up to the waste solution surface because of its lighter specific gravity and it is solidified as the temperature of the waste solution is lowered, so that it seals over the upper side of the waste solution.

In addition to the above, the above-mentioned sealing method, i.e., a layer-forming method, may be emdodied also with a resin capable of displaying a hardening property at an ordinary temperature.

In the above-mentioned embodiments, it is preferred to provide an unevennnes to the internal walls of a vessel serving as a processing tank so that a solidified sealing member may be catched on, without getting the solidified sealing member out of place or leaking the solution even when waste solution vessel 150 is upside down or toppled sideways.

The automatic processors of the invention can be so miniaturized as to enable any unskilled operators to render photofinishing services in such a simple opration that exposed disc films are put into the processor as the disc films remain loaded in cartridges.

In addition to the above, the following advantages can also be enjoyed and the various problems first above described can also be solved.

A. When a disc film is taken out of a cartridge, the upper mechanism is so regulated as to be shielded against light, so that an accident of erroneously exposing the naked disc film to light can be prevented;

B. Broken pieces, which may be produced when a cartridge is fragmented by a cartridge opener, may not be dropped into a processing tank, and a disc film is not damaged by scratch or the like when it is processed with rotating; and C. Plural disc films may be taken out in succession from their cartridges to insert into a processor, respectively, because the portion above a guide member where disc films are present is shielded against light.

Now, the following examples will be described, namely; an example of the light-shielding means of the invention capable of automatically opening and closing a film unit inlet; and an example of the means of the invention capable of separately delivering an empty cartridge from which a disc film was already taken out and the already processed disc film, from sepearate outlets, respectively.

Figure 11:
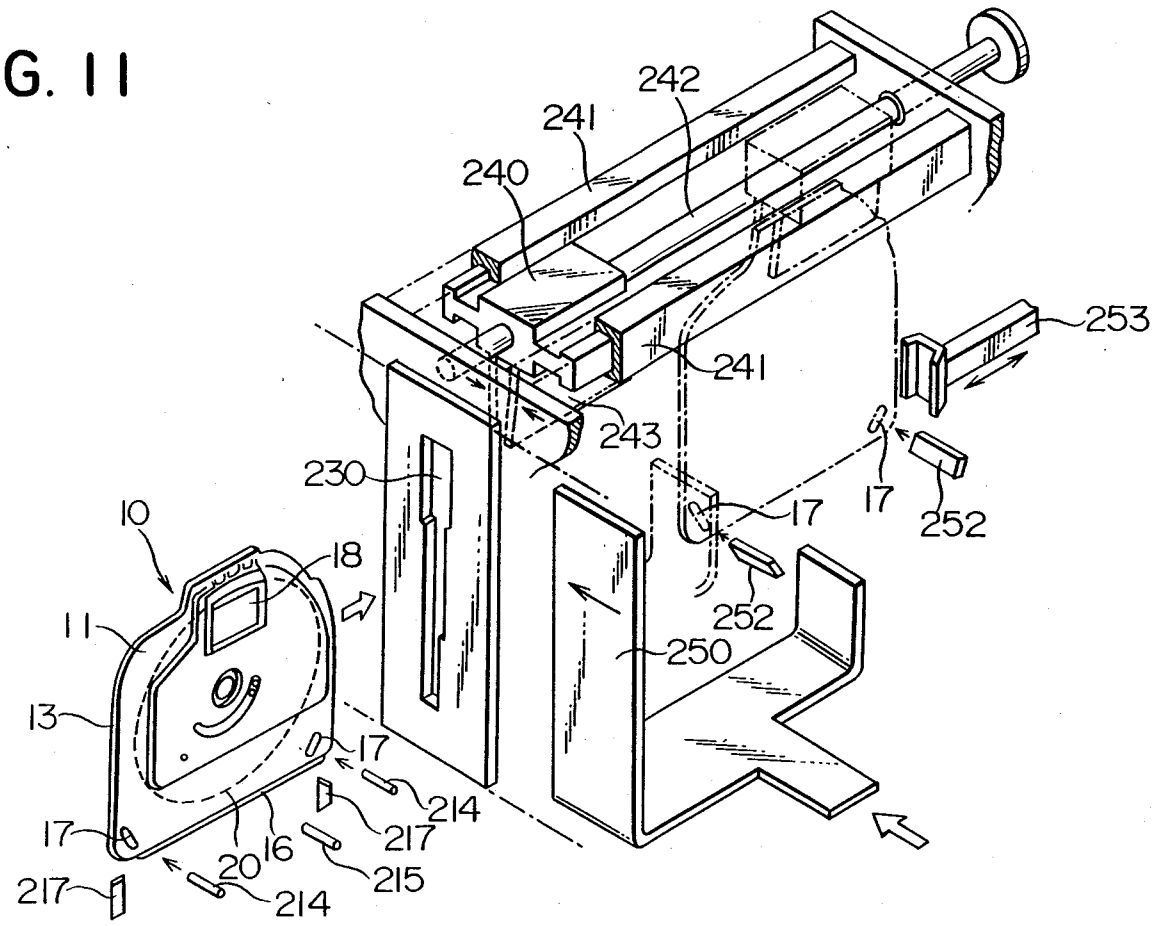

FIG. 11 illustrates an embodiment of the invention, in which, after a simple operation is carried out to insert a film unit 10 subject to a processing, with taking such a posture as shown in the drawing, into inlet 230, the film unit 10 is automatically taken in, transported and then held, and a disc film 20 is taken out of a cartridge 11 in a fixed position by a means which will be mentioned later, so that the disc film 20 may be processed.

The size and configuration of inlet 230 correspond to the sectional configuration of cartridge 11 of film unit 10. Such a cartridge may be inserted into the inlet 230 only when the cartridge takes the posture shown in the drawing, and it is so arranged as not to be inserted whenever it takes any other postures.

Reference numeral 240 is a traveling member and the both ends thereof are supported with guide rails 241, 241, respectively. The travelling member 240 is reciprocated linearly by the rotation of worn member 242 driven by a motor (not shown).

On the lower side of travelling member 240 is provided with film unit holding member 243. When a film unit 10 subject to be processed is inserted, in the posture shown in the drawing, into inlet 230 to a certain depth, the holding member 243 couples to the both sides of the exposure window 18 of the film unit 10. When the worm member 242 is rotated in the normal direction in this state, film unit 10 is then transported to the position indicated by an imaginary line as it is being hung from the lower side of travelling member 240.

When the number of revolution of the motor or other sensor detects that film unit 10 was transported to the fixed position, a drive means such as a solenoid or the like (not shown) starts to push a light-shielding plate 250 in the direction of the arrow, so that inlet 230 is closed to shield against light.

When film unit 10 is guided to the position indicated by the imaginary line, a stopper 251 for regulating the position of the trailing end of the film unit 10 moves synchronously with the light-shielding plate 250, so that the trailing end thereof may be regulated for the fragmentation of a cartridge, of which will be described later.

As shown in the drawing, light-shielding plate 250 keeping inlet 230 in the light-shielded state is united into a body with stopper 251 for positioning the trailing end of cartridge 11. In such a state where the light-shielding plate 250 moves toward the arrow mark to keep the inlet 230 opened, stopper 251 will not work and cartridge 11 cannot be fragmented even if a malfuntion should occur in the post steps, so that a fail-safe may be assured by this structure. It is the matter of courst that the completion of the movements of light-shielding plate 250 and stopper 251 may be detected by a sensor of various kinds, so that an automatic control may be performed. Further, in such a construction as those of the invention, a double fail-safe structure may be embodied so as to effectively prevent any erroneous exposure of unprocessed disc films to light.

This invention shall not be limited to the above descriptions, but shall include the following other embodiments of which will now be described below.

Figure 12:
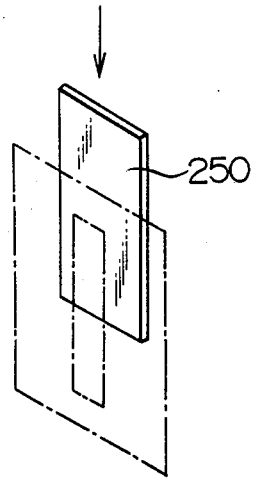
FIGS. 12 through 14 are shcematic diagrams illustrating other embodiments of light-shielding means, respectively.
Figure 13:
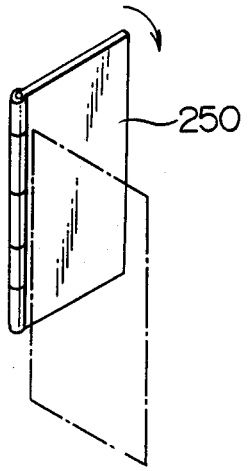
Figure 14:
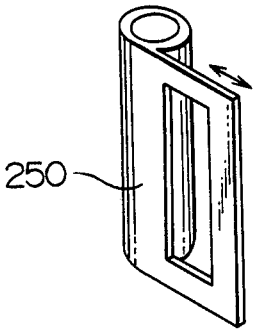
Figure 15:
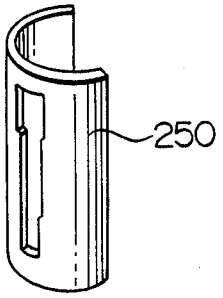

The embodiment shown in FIG. 12 is that inlet 230 is closed by moving light-shielding plate 250 up and down; the embodiment shown in FIG. 13 is that light-shielding plate 250 is moved like a hinge; the embodiment shown in FIG. 14 is that light-shielding plate is made of a light-shielding curtain having, in a portion thereof, a slit through which a cartridge passes; and the embodiment shown in FIG. 15 is that inlet 230 is provided to a portion of a cylindrical or semi-cylindrical light-shielding plate 250, so that the opening and closing of inlet 230 may be switched over by the rotation of the light-shielding plate 250.

While the light-shielding mechanisms of inlet 230 relating to the invention has been described as above, an example on how to process a film unit 10 after it was taken in an automatic processor of the invention will be described.

Reference numerals 252, 252 are pushing-out pins each reciprocate in the direction of the arrow by the driving force of a solenoid or the like (not shown). The pin tips are inserted into openings 17, 17 for breaking a cartridge provided to film unit 10 so as to push out the both lower ends of label side plate 13. Synchronizing with this action, the surroundings of the openings 17, 17 of exposure window side plate 11 are supported by supporting member (not shown) from the rear side. Resultingly, when moving the pushing-out pins 252, 252 to the upper left in the drawing, the lower end of exposure window side plate 11 does not move because it is supported by the supporting member from the rear side, but only the lower end of label side plate 13 is pushed out by pushing-out pins 252, 252, so that only the connection between exposure window side plate 11 and label side plate 13 is broken by the lower end portions thereof.

In addition to the above, it is also allowed to jointly use a member for simultaneously pushing out the lower end 16 of the label side plate 13.

When the lower end side of a cartridge is broken, pushing-out pins 252, 252 are restored to the original positions together with the supporting member (not shown) on the bach side and, next, swinging member 253 reciprocates in the direction of the arrow so as to repeat the swinging motions to apply pressure and release the pressure from the lateral direction of the cartridge.

In this instance, such a pressure may be applied and released either continuously or intermittently. It is also allowed to make a repetition such as (a pressure application-pressure release) and (Pressure application-pressure application-pressure release) to which there is no special limiataion.

From the results thereof, the cartridge is bent by applying a pressure from the lateral direction and the broken lower end of the cartridge is opened, so that a disc film 20 stored therein is dropped to guide section 260 arranged below.

The dropping of disc film 20, i.e., the completion of taking it out of a cartridge, may be detected by a sensor utilizing infra-red rays or the like, so that swinging member 253 is stpped in motion.

Figure 16:
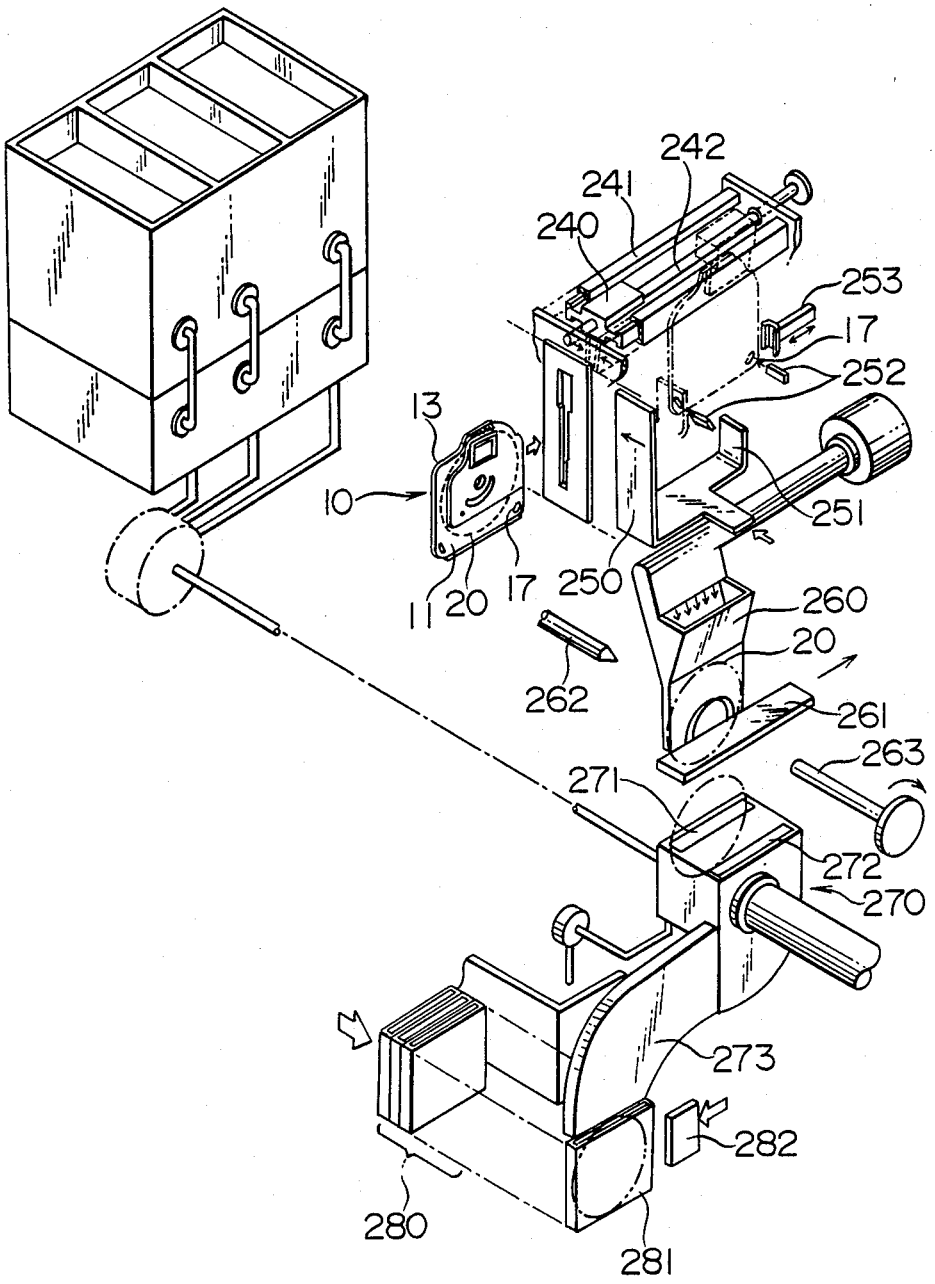
FIG. 16 is a perspective view illustrating an example of the delivering means of the invention.
Figure 17:
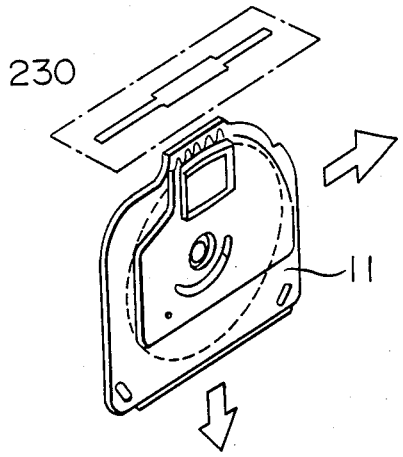
FIGS. 17 through 19 are the perspective views illustrating other embodiments of the invention, respectively.
Figure 18:
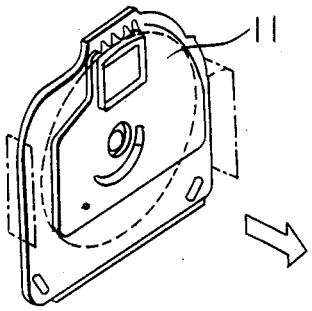

How to load and take out a disc film 20 shall not be limited to the above, but it is allowed to use any other constitutions. For example, while in the embodiment shown in FIG. 11 and 16, a film unit 10 is vertically set and is then taken in as it is in the direction of the arrow, it is also allowed to take it in either in the vertical direction or in the surface direction, as shown in FIGS. 17 and 18.

Disc film 20 having been droped into guide section 260 is stopped once by stopper 261 so as to be coupled to spindle shafts 262, 263. To be more concrete, the spindle shafts 262, 263 move to the direction of the arrow to couple to the center core portion of the disc film 20. In this instance, the tip of the spindle shaft 262 is so devised to be in the convex-form and the tip of spindle shaft 263 in the concave-form, respectively, so that they may readily, surely be able to couple to disc film 20. When the coupling of disc film 20 to spindle shafts 262, 263 is completed, stopper 261 moves to escape in the direction of the arrow.

Reference numeral 270 is a processing section. In this section, when either a processing tank 271 goes up or spindle shafts 262, 263 go down, a disc film 20 being held by the spindle shafts 262, 263 is dipped, down with the center core or the neighborhood, into the processing solution of processing tank 271, so that the disc film 20 is rotated by the rotation of the spindle shafts 262, 263, and is then processed.

When a caetain processing was completed, the disc film 20 is pulled up from the processing tank 271 and is then dropped into a guide section 272. The disc film 20 having been dropped into the guide section 272 is transferred into a guide path 273 immediately through the guide section 272 or by the clockwise rotation of the guide section 272 as shown in the drawing, and the disc film 20 is then stored in cases 280 provided below, with rolling down in the guide path 273.

As shown in the drawing, a plurality of cases 280 are provided. When a processed disc film 20 is stored in the forefront case 281, a pushing-out member 282 moves to the direction of the arrow to deliver the case 281 containing the disc film 20 out of the processor, and then the nest case 280 is guided to the forefront position.

Coupling to the above-mentioned operation or about the time of the coupling, light-shielding plate 250 and stopper 51 are restored to the original positions and empty cartridge 11 is delivered out of the processor through inlet 230 by the reverse rotation of worm 242.

Figure 19:
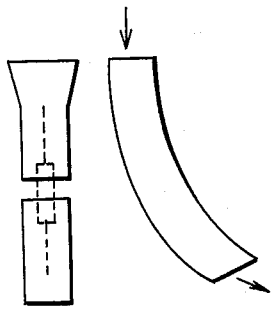

As shown in FIG. 19, it is also allowed that empty cartridge 11 is not delivered out of a processor through inlet 230, but it is delivered out through an outlet which is separately arranged. In this type of embodiments, such an empty cartridge outlet is so devised as not to hinder a disc film 20 from being taken out. For example, the outlet is moved by a solenoid or the like so as to escape from the path of the disc film 20.

With the automatic processors of the invention for processing disc films, it is good emough that an operator insert a subject film unit taking a prescribed posture into a processor. Thereafter, the procedures of picking the film unit into the processor, breaking a cartridge, picking out a disc film, processing the disc film and delivering out the processed disc film can be carried out, respectively, by a built-in mechanism. Therefore, the objects of the invention first mentioned, such as the miniaturization of a processor, the easiness in operations and so forth, can be achieved.

According to the construction relating to the invention, a cartridge opener cannot be operated until a loaded film unit can be placed in a safe and light-shielded state. It can effectively be prevented that any unprocessed disc film is erroneously exposed to light and, therefore, the objects of the invention fist mentioned can be achieved.

What is claimed is:

1. An apparatus for handling a disc film unit, said unit comprising a disc-shaped photographic film having a hub at a rotation center thereof and a cartridge having a light shielding structure for storing the film therein, said apparatus comprising;

a housing means having an open portion through which said film unit is introduced into said housing means and a cover member for covering said open portion and shielding the inside of said housing means from light, a cartridge opening means for at least partially opening said cartridge housed in said housing means, and a treatment means for treating the film in said housing means, said treatment means having a processing means for processing said film with a processing solution and an agitation means for agitating said processing solution, wherein said film remains inside the cartridge opened by said cartridge-opening means in said housing means during processing, said treatment means supplying processing solution to said housing means so that said film is contacted by the processing solution.

2. The apparatus of claim 1 wherein said agitation means is a rotation means adapted to engage the hub of said disc film and rotate said disc film to agitate the processing solution.

3. The apparatus of claim 1 wherein said cartridge-opening means is positioned at the upper part of the inside of said housing means and said treatment means is positioned at the lower part of the inside of said housing means.

4. The apparatus of claim 3 wherein said agitation means is a rotation means adapted to engage the hub of said disc film and rotate said disc film to agitate said processing solution.

5. The apparatus of claim 3 wherein said housing means is watertight.

6. The apparatus of claim 1, wherein said housing means is constructed to be watertight so as to store the processing solution therein.

7. An apparatus for handling a disc film unit, said unit comprising a disc-shaped photographic film having a hub at a rotation center thereof and a cartridge having a light-shielding structure for storing the film therein, said apparatus comprising;

a housing means having an open portion through which said film unit is introduced into said housing means, and a cover for covering said open portion, shielding the inside of said housing means from light, a cartridge-opening means for opening said cartridge housed in said housing means and a treatment means for treating the film in said housing means, said treatment menas having a processing means for processing said film with a processing solution and an agitation means for agitating said processing solution, wherein said film is removed from the opened cartridge and dropped downward into said treatment means through a guiding means, said guiding means being adapted to prevent said opened cartridge from dipping into said treatment means.

8. The apparatus of claim 7, wherein there is provided a stop means for preventing the dropped film from directly dropping into said treatment means.

9. The apparatus of claim 7, wherein there is provided a discharge means for respectively delivering the processed film and the empty cartridge through respective exit to the outside of said housing means.

10. The apparatus of claim 7, wherein said cartridge opener is positioned at the upper part of the inside of said housing means and said treatment means is positioned at the lower part of the inside of side housing means, and wherein the film is taken out of the broken cartridge by said cartridge opener and is introduced to said treatment means through a guiding passage.

11. The apparatus of claim 10, wherein there is provided a partition member between the upper part and the lower part of said housing means, and wherein there is further provided a light-shielding member for covering the guiding passage the so that a new film unit can be introduced into the upper part while processing a current film at the lower part.

12. The apparatus of claim 7, wherein said cover member has a mechansim for opening and closing the opening portion, and wherein said open-close mechanism is interlockingly actuated with operation of said cartridge opener.

13. The apparatus of claimed 12, wherein a cover plate capable of shielding the opening portion is united into one body with a movable member of said cartridge opener.

* * * * *